United States Patent [19]

Mayer et al.

[11] 3,957,446

[45] May 18, 1976

[54] SWIRL REACTOR FOR EXHAUST GASES

[75] Inventors: Edward A. Mayer, Newburgh; Martin Alperstein, Fishkill; John T. Brandenburg; Edward Mitchell, both of Hopewell Junction, all of N.Y.

[73] Assignee: Texaco Inc., New York, N.Y.

[22] Filed: Aug. 12, 1974

[21] Appl. No.: 496,490

Related U.S. Application Data

[63] Continuation of Ser. No. 244,165, April 14, 1972, abandoned.

[52] U.S. Cl. ..... 23/288 F; 23/277 C; 60/302; 60/303; 60/323; 60/278; 60/282; 110/8 A; 431/5; 431/9; 432/352

[51] Int. Cl.[2] ..... F23G 7/06; F01N 3/15

[58] Field of Search ..... 23/288 F, 277 C; 60/302, 303, 323, 278, 282; 110/8 A, 28 F; 431/171, 172, 173, 5, 9, 352

[56] References Cited

UNITED STATES PATENTS

| | | | |
|---|---|---|---|
| 1,605,484 | 11/1926 | Thompson et al. | 23/288 F UX |
| 2,833,615 | 5/1958 | Kollgaard | 23/288 F UX |
| 3,013,628 | 12/1961 | Jacobs et al. | 23/277 C |
| 3,066,755 | 12/1962 | Diehl | 60/303 X |

*Primary Examiner*—James H. Tayman, Jr.
*Attorney, Agent, or Firm*—T. H. Whaley; C. G. Ries; Robert B. Burns

[57] ABSTRACT

A thermal reactor adapted to receive hot exhaust gases generated as the result of the combustion of a hydrocarbon fuel within an engine. The hot exhaust gas stream taken directly from the engine, is passed into a chamber where it reacts with air, preferably in the presence of a reaction promoting element. However, prior to the reaction stage, the hot gas is urged into a swirling motion and through a constricted passageway whereby to provide through a longer dwell period, better mixing, and avoid direct impingement of the gas against the catalyst bed surface when the latter is utilized.

5 Claims, 3 Drawing Figures

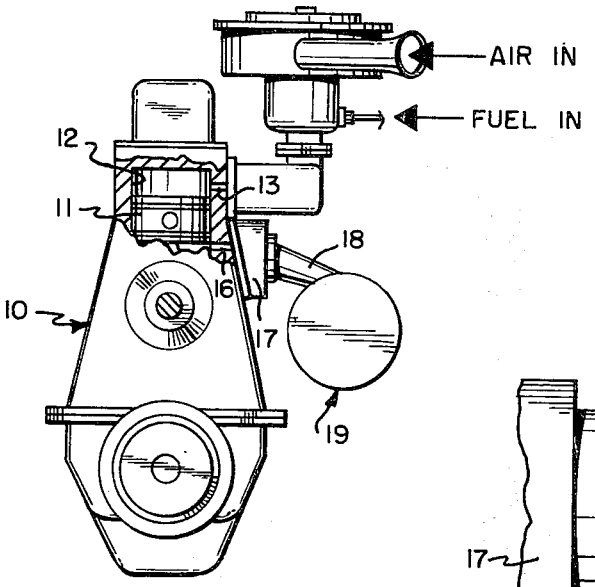
FIG. 1
FIG. 2
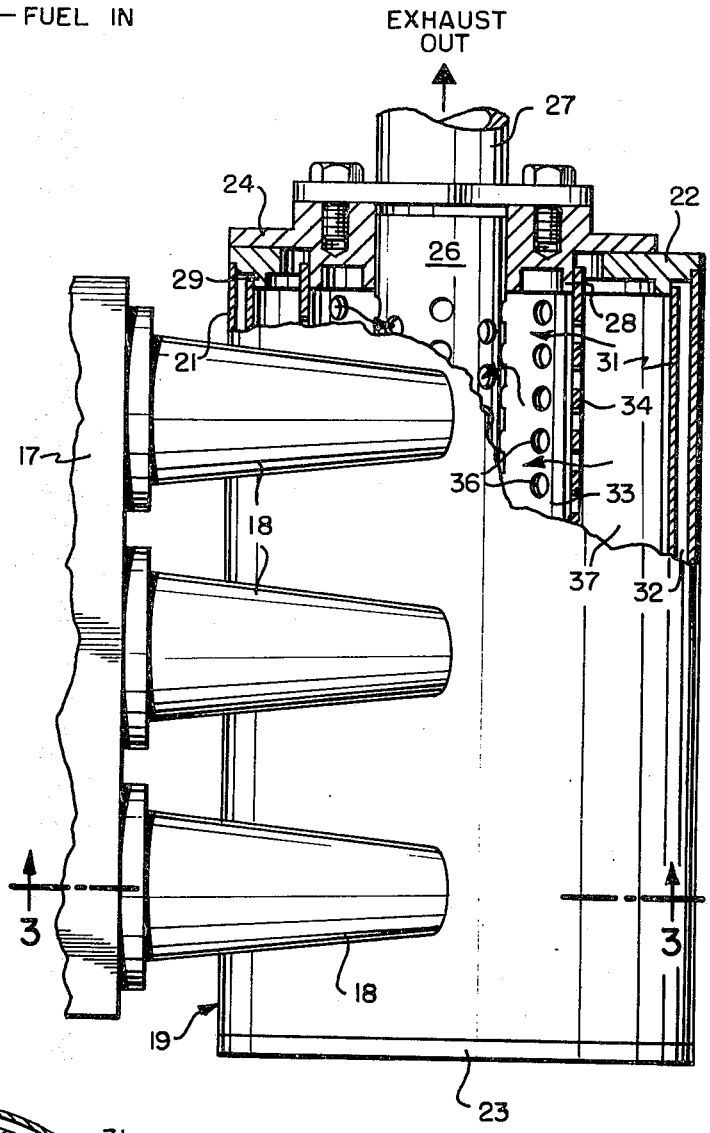
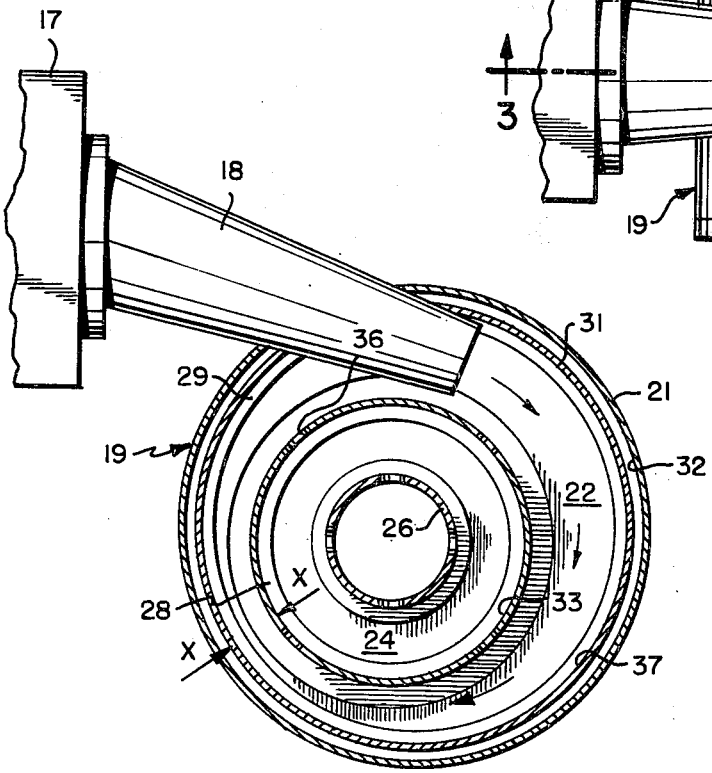
FIG. 3

SWIRL REACTOR FOR EXHAUST GASES

This is a Continuation application of our parent application Ser. No. 244,165, dated Apr. 14, 1972 and presently abandoned.

BACKGROUND OF THE INVENTION

The invention herein described was made in the course of or under contract or subcontract thereunder withh the U.S. Department of Defense.

During the combustion of a hydrocarbon fuel mixture within an engine's combustion chamber, the exhaust product will normally contain a variety of environmentally objectionable gases. These gases are at varying temperatures, and are present whether the engine be of the common internal combustion variety, diesel, rotary combustion type, or other.

Further, the heated exhaust gases will be generated in the manner noted, whether the incoming fuel mixture be in the form of either a premixed or a stratified charge. In any instance it has been found that the hot exhaust gas stream subsequently passed to the atmosphere will include not only a percentage of unburned hydrocarbons, but also various pollutants such as CO and $NO_x$ in varying quantities.

The exhaust gas composition can of course be varied or altered by adjusting conditions at the engine inlet side. Such alterations include the known expedients of regulating the charge make-up, the temperature, distribution of the charge, and the speed of the engine.

It has been found however that the composition of the exhaust gas can also be controlled to a degree through the utilization of any one of a number of facilities.

One such exhaust gas control medium found to be particulary effective and economically practical, is the use of a catalyst bed or similar reaction promoting element disposed in the path of the hot exhaust gases. It has further been determined that the composition of the various exhaust gas components can be adjusted favorably by reaction with air or other introduced element.

It is therefore among the objectives of the invention to provide a method and apparatus whereby the thermal conditions of a hot exhaust gas can be maintained or improved, and the gas thoroughly mixed and reacted, toward subsequent further reaction thereof whereby to diminish its atmosphere polluting characteristics. This is achieved by subjecting the hot exhaust gas, soon after leaving the engine exhaust ports, to intimate mixing and reaction within a high velocity swirling stream. The swirled, non-stratified partially reacted flow is thereafter introduced to a reaction chamber in which it is reacted in the presence of air, whereby to be reduced to a less air polluting composition.

The desired objectives of the invention are achieved by providing a reactor vessel which receives a stream of engine exhaust gas. The latter comprises the hot gaseous residue resulting from the combustion of a hydrocarbon fuel mixture within the engine's combustion chamber. Said heated gases are introduced to the first stage of the thermal reactor in a manner, and at such a velocity to be impinged against, and deflected from a shield element. The latter then urges the gaseous stream into a swirling motion adjacent the reactor wall periphery.

The gas stream, thereafter in a more homogeneous rather than in a stratified mixture, enters the unit's high temperature reaction chamber, where its reaction with a medium such as air is accompished. The resulting still heated flow, is then in a suitable condition to be passed from the reaction chamber and discharged into the atmosphere or otherwise disposed of.

DESCRIPTION OF THE DRAWINGS

In the drawings,

FIG. 1 illustrates diagrammatically, an internal combustion engine having a swirl reactor of the type herein described depending therefrom. FIG. 2 is a vertical element of the instant reactor for a 3 port inlet, shown in partial cross section with a portion broken away to illustrate internal parts. FIG. 3 is an enlarged cross sectional view taken along line 3—3 in FIG. 2.

Referring to FIG. 1, an internal combustion engine 10 is shown, which constitutes or embodies the usual cooperating components. These include one or more combustion chambers 11 wherein cylinders 12 are reciprocably mounted. A controllably metered charge of fuel and air is periodically introduced into the respective cylinders by way of inlet means 13. The mixture is compressed and ignited to drive the pistons. Hot exhaust gases resulting from the combustion are than forced from the combustion chamber 11 by exhaust means 16, and into exhaust port 17.

In an internal combustion engine, subsequent to the compressed fuel charge being fired on the power stroke of the piston, hot residual gases are discharged through exhaust means 16 into an exhaust manifold, here numbered 17. In the normal operation of this type of engine, the stream of hot exhaust gases would ordinarily be directed through a conductor member to a muffler and thereafter passed to the atmosphere.

However, in the instant arrangement, engine exhaust is conducted in discrete streams through one or more duct 18 directly from the ports in the cylinder head, to the inlet of thermal reactor 19. The latter receives said gas flows, mixes them, and subsequent to reactively treating the gas, discharges it through a port at one end of the reactor. At this point of the flow, the gases have been reacted and converted such that the out flow passed to the atmosphere is of such composition as to avoid the undesired polluting effect.

Referring to FIGS. 2 and 3, reactor vessel 19 comprises an elongated shell 21 fabricated of stainless steel or other heat resistant metal.

Shell 21 as shown in FIG. 3, is preferably circular in cross section, a configuration that lends itself toward maximum strength, and resistance to extremes in thermal gradations realized during a normal engine's operating cycle. Such gradations in temperature can extend in range from below zero in accordance with the atmospheric temperature, to substantially above 1,000°F. Thus, outer shell 21 is preferably fabricated of relatively rigid material, and of welded or formed structure to best withstand the above stated operating conditions.

The respective opposed ends of the shell 21 are provided with end plates 22 and 23 which form a closure to the shell, thereby defining a closed internal compartment. While the reactor 19, as shown in FIG. 2 is illustrated in a vertical elevation, it is assumed that in normal operation it would be disposed horizontally and aligned parallel to the one or more engine exhaust ports.

Upper end plate 22 is provided with a peripheral edge which is fastened to the shell in a manner to define the herein noted closed internal compartment. Said end plate 22 as shown, is welded in place for the purpose of providing necessary strength and rigidity to the structure. It is understood, however, that as a manner of fabricating expedience, and to permit access to the reactor 19 interior, at least one of said end plates 22 or 23 can be removably connected to the shell whereby it can be detached therefrom as required.

End plate 22 includes a center portion 24 which extends outwardly from the plate surface. A central passage 26 formed in said center portion defines an outlet opening from the reactor. The latter opening can be further provided with a removably connected conduit 27 or the like to direct processed exhaust gases to the atmosphere or to a further cooling means.

The inner surfaces of the respective end plates, 22 for example, are provided with upstanding positioning rims 28 and 29 disposed substantially concentric one with the other. As shown in FIG. 3, discharge opening 26 is eccentric with respect to shell 21 for the reasons to be herein noted. Said respective positioning rims however extend inwardly toward the reactor center and function to operably position members held within the reactor body.

Referring to FIG. 2, a shield 31 is spaced inwardly from the inner wall of shell 21, and is defined as shown in FIG. 3 by a relatively cylindrical member. Said shield 31 functions to receive, and deflect or guide the incoming heated exhaust gas stream in a manner to induce the swirling motion thereto. Shield 31 is thus preferably cylindrical in configuration, although a similar guiding effect can be achieved through an alternate shape such as an oval configuration or the like.

In either instance, shield 31 is fabricated of a metal, ceramic or other material having a surface adapted to withstand the high temperature (1500°–1800°F.) of the impinging exhaust gas stream. Further, shield 31 can be fabricated with a curved surface in a manner to define discrete sections thereof which are coated or otherwise treated to withstand the initial impingement of the incoming exhaust gases. In the present embodiment, shield 31 defines a continuous guide wall against which the swirling gases are guided about the reactor compartment.

Shield 31 is disposed immediately adjacent to, but spaced from the inner wall of the shell 21 to define an annular space 32 therebetween. Under normal circumstances such annular space 32 will be occupied by stationary exhaust gases. The space in effect, thereby serves as a form of insulating barrier for the hot interior whereby to maintain the desired high temperature of circulating or swirling exhaust gases.

Shield 31 is operably positioned contiguous with shell 21 wall by being slidably retained intermediate the opposed corresponding rims on the respective end plates 22 and 23. As shown particularly in FIG. 2, shield 31 end is slidably positioned on the outer surface of rim 29, and spaced sufficiently far from the surface of end plate 22, to define a variable spacing therebetween when the reactor is in either the heated or cooled condition.

Since under normal circumstances reactor 19 will vary in temperature between relatively extreme atmospheric temperatures, up to approximately 1500°F. to 1700°F., there will be a substantial degree of expansion and contraction of interconnected parts. The slidable or operable positioning of the shield 31 thus assures that said member will be held properly to achieve its desired function of guiding and deflecting gases regardless of the temperature of incoming gas, or of the reactor 19 as a whole.

Shield 31 as mentioned can be coated along its inner surface, particularly at those discrete areas subject to gas impingement, to protect the shield from excessive thermal wear or degradation. The shield coating also protects the shield from high temperature effects which result from the continuous reaction within annulus 37.

The noted positioning of shield 31 serves the further advantage of the latter being loosely retained and consequently amenable to be rotated. Thus, the area of hot gas impingement will be distributed about the entire periphery of the shield section rather than being concentrated. The non-rigid retention of this element, which is of course subject to extreme wear, will permit the ready replacement thereof at such time as it becomes ablated or worn to the point where it no longer functions as it should.

The presence of shield 31 achieves the further objective of maintaining a high temperature within the reactor. Since radiation losses dominate at the temperature of interest, shield 31 serves to substantially halve such losses.

Normally, the swirling stream of gas about the inner wall of shield 31, will permit the progressive passage of said gas into the inner positioned reaction chamber 33. However, the guiding surface of said shield walls can be provided with gas deflecting means such as vanes or the like whereby to particularly direct the flow of the swirling hot gases into a desired direction or pattern.

Reaction chamber 33 into which the swirling gases are directed as defined by an elongated casing 34 extending substantially the length of the unit 19. Said casing member 34 as shown, particularly in FIG. 3, is formed by thin walled cylindrical members having a plurality of inlet apertures or perforations 36 formed therein to admit the circumferentially flowing hot exhaust gas. The inner wall of reaction chamber 33 is defined as noted above, by an elongated central annular tube 38 extending the length of the reaction chamber 33 and terminating at exhaust port 26.

Said chamber 33 outer wall comprises cylindrical member 34 having the open ends thereof loosely maintained between their respective positioning rims 28. As previously mentioned with respect to heat shield 31, operable or sliding retention of the reaction chamber wall permits expansion of the latter either laterally or longitudinally within the confining limitations of the respective positioning rims.

Annular reaction chamber 33 normally receives heated, thoroughly mixed exhaust gases, which are reacted therein in the presence of an oxidizing atmosphere or in the presence of a catalytic medium. While not presently shown in detail, said reaction chamber 33 can be provided with a suitable material adapted to perform the catalytic function as well as to serve as a sound muffling medium for the high velocity gases. A suitable catalyst for use in reaction chamber 33 is one such as disclosed in U.S. Pat. No. 3,231,520 or U.S. Pat. No. 3,362,783. Such a material comprises a catalytic medium carried on a support element such as the disclosed Leak alumina.

In this respect reaction chamber 33 can be provided with a bed or body of catalyst holding alunina or the like which is packed into the reaction chamber. For the reasons previously mentioned, the loose fitting reaction chamber casing 34 can be repacked with a new catalyst or otherwise refurbished to maintain the efficiency of the reactor unit in treating the exhaust gas.

Referring to FIG. 3, toward promoting the rapid velocity swirling motion of the hot exhaust gases through the annular swirl reaction chamber 37, reaction chamber 33 is disposed eccentrically from the center of the outer shell 21. Thus, said swirl chamber is formed with a generally wide cross section at the point of admission of the hot exhaust gases. Said cross section however is gradually reduced between the converging walls of the shield 31 and casing 34 to a maximum constricted section. The increase of velocity through the constricted area, which terminates at the section X—X, thus promotes a more efficient swirling and mixing of the gas regardless of its original entering condition.

Other modifications and variations of the invention as hereinbefore set forth may be made without departing from the spirit and scope thereof, and therefore, only such limitations should be imposed as are indicated in the appended claims.

We claim:

1. A reactor for treating hot exhaust gases which result from the combustion of a hydrocarbon fuel mixture within a combustion chamber, the latter having an exhaust port for discharging a hot exhaust gas stream, which reactor comprises;

means forming an elongated swirl passage having a guide wall extending longitudinally of said reactor, inlet means opening into said means forming said swirl passage and being communicated with said exhaust port to direct a stream of hot exhaust gas tangentially aginst said swirl passage guide wall, whereby the latter will urge said exhaust gas stream into a rapidly swirling pattern within said swirl passage, means forming an elongated reactor chamber communicating with said swirl passage, having an outer wall extending longitudinally of said swirl passage guide wall and being spaced inwardly from the latter to define an annulus therebetween, and discharge means in said reactor chamber for passing treated exhaust gas therefrom, said annulus formed between said guide wall and said reactor chamber outer wall respectively, being progressively narrowed from said inlet means, for a distance approximately one-half of the annulus to a point of maximum constriction adjacent to said guide wall, and extending longitudinally of said reactor chamber whereby to increase the velocity of gas flow in said gas swirl forming passage as said gas progresses through said swirl forming passage.

2. In an apparatus as defined in claim 1, wherein said guide wall and reactor chamber wall respectively, comprise substantially cylindrical members positioned eccentrically one to the other whereby to define said progessively narrowed annulus therebetween.

3. In an apparatus as defined in claim 1, wherein said reactor chamber includes a plurality of spaced apart openings formed in the wall thereof adjacent to and down stream of said constricted opening.

4. In an apparatus as defined in claim 1, wherein said inlet means opening into said means forming said swirl passage, includes a plurality of longitudinally spaced ducts having discharge ports directed toward said swirl passage guide wall.

5. In an apparatus as defined in claim 1, including a causing means spaced outward from and enclosing said swirl passage guide wall to define an annular space therebetween.

* * * * *